US007770734B2

(12) United States Patent
Saitou et al.

(10) Patent No.: US 7,770,734 B2
(45) Date of Patent: Aug. 10, 2010

(54) PACKING IMPLEMENT FOR GOODS TRANSPORTATION

(75) Inventors: Takeshi Saitou, Saitama (JP); Hisae Saitou, legal representative, Saitama (JP); Miho Ohno, legal representative, Saitama (JP); Kumi Suzuki, legal representative, Ageo (JP); Rie Kawasaki, legal representative, Toda (JP); Kouichi Kasiwabara, Tokyo (JP)

(73) Assignee: Yamato Packing Technology Institute Co., Ltd., Tokyo (JP)

( * ) Notice: Subject to any disclaimer, the term of this patent is extended or adjusted under 35 U.S.C. 154(b) by 693 days.

(21) Appl. No.: 11/369,815

(22) Filed: Mar. 8, 2006

(65) Prior Publication Data

US 2006/0213803 A1 Sep. 28, 2006

(30) Foreign Application Priority Data

Mar. 9, 2005 (JP) ..... 2005-065168

(51) Int. Cl.
*B65D 85/30* (2006.01)

(52) U.S. Cl. ..... 206/583; 206/594; 206/591

(58) Field of Classification Search ..... 206/583, 206/591, 592, 594, 521, 497, 320, 305
See application file for complete search history.

(56) References Cited

U.S. PATENT DOCUMENTS 5,678,695 A * 10/1997 Ridgeway et al. ..... 206/583
5,975,307 A * 11/1999 Harding et al. ..... 206/583
6,073,761 A * 6/2000 Jones ..... 206/223

(Continued)

FOREIGN PATENT DOCUMENTS

JP 2004-276957 10/2004

*Primary Examiner*—David T Fidei
(74) *Attorney, Agent, or Firm*—Manabu Kanesaka

(57) ABSTRACT

To provide a packing implement for goods transportation that facilitates packing in the transportation of the goods and is a combination of a baseboard and a holding sheet. The baseboard is a rectangular board for supporting an article to be transported at a fixed position, and has rising parts, falling parts and shape retaining parts. The rising parts are folded back upward from both end edges of a short side of the baseboard, the falling parts are folded back downward from both side edges of a long side of the baseboard, respectively, the falling part is constituted by a leg part orthogonal to the baseboard and a bottom part which is bent parallel with the baseboard, and a buffer space corresponding to a rising height of the leg part of the falling part is formed by the leg part bent so as to be orthogonal to the baseboard and the bottom part bent parallel with the baseboard. The shape retaining part is a corner part of the baseboard left between an end edge of the rising part and an end edge of the falling part. The shape retaining part is continued to the ring part and the falling part, is folded back parallel with the rising part when the end edge of the falling part is bent to a lower surface side of the baseboard, and is erected to hold the falling part bent when the rising part is folded back upward. The holding sheet is bridged over a surface of the baseboard and attached to both the falling parts, covers a surface of the article on the baseboard, is tensed by bend of the falling part, and presses and fixes the article to the baseboard.

10 Claims, 11 Drawing Sheets

U.S. PATENT DOCUMENTS 6,148,591 A * 11/2000 Ridgeway et al. ..... 53/499
6,158,589 A * 12/2000 Smith et al. ..... 206/466
6,311,843 B1 * 11/2001 Smith et al. ..... 206/583
6,311,844 B1 * 11/2001 Ridgeway et al. ..... 206/583
6,467,624 B1 * 10/2002 Lofgren et al. ..... 206/583
6,675,973 B1 * 1/2004 McDonald et al. ..... 206/583
6,942,101 B2 * 9/2005 Lofgren et al. ..... 206/583
2004/0084349 A1 * 5/2004 Kari ..... 206/583
2004/0188309 A1 * 9/2004 Kudou et al. ..... 206/521
2007/0080095 A1 * 4/2007 McDonald et al. ..... 206/583

* cited by examiner

PACKING IMPLEMENT FOR GOODS TRANSPORTATION

BACKGROUND OF THE INVENTION AND DESCRIPTION OF THE RELATED ARTS

The present invention relates to a packing implement for goods transportation for housing and transporting various goods such as notebook computers, more particularly, it relates to a packing implement for goods transportation suitable for home delivery services.

There has been a dramatic increase in the need for transportation of notebook computers with the spread of notebook computers. A case has been seen recently where a request for repair, memory extension or the like of notebook computer from a user is received by a maker's repair center only with mail service or home delivery service rather than direct carrying in by a user.

In this case, the notebook computer sent from the user to the maker and repaired or maintained is also sent back from the maker to the user with the mail service or home delivery service. Packing of the notebook computer in transportation with the mail service or home delivery service is required to sufficiently protect the notebook computer from impacts.

In the transportation of the notebook computer, although it is possible for the maker to take a sufficient protection measure necessary for the packing or to standardize the packaging to a certain quality, it is not always easy for the user having no packing material to take the sufficient protection measure necessary for the packing unless an exclusive packing implement for notebook computer transportation is provided.

As a conventional packing implement for goods transportation, for example, a membrane packing is disclosed in U.S. Pat. No 4,852,743 of which a center opening of a board surface employs a pair of rigid frames made of pliable and stretchable film and which allows placement of an article or solid object between the pair of rigid frames to be housed in a casing and protects the article or solid object from impacts. On the other hand, as a more simplified packing implement, for example, a packing device is disclosed in Japanese Published Unexamined Utility Model Application No. H3-100158 that is constituted by a combination of a rectangular pasteboard that an article is positioned at a center part thereof and a synthetic resin film which covers the article and of which a fringe part is fixed to the pasteboard, and that bends both side parts of the pasteboard toward the housed article side to make both side parts face both side surface parts of the article.

On the other hand, as shown in FIG. 9, a packaging structure disclosed in U.S. Pat. No. 5,678,695 is constituted by a combination of a baseboard and a flexible film similarly to the above. In the packaging structure, the flexible films which serve as a holding sheet 22 are stacked on a board surface of a rectangular baseboard 21, and both edges of the holding sheet 22 are adhered to both ends of the baseboard 21. An article M to be housed is placed between the baseboard 21 and the holding sheet 22 as shown in FIG. 10, both side edge parts 24 of the baseboard 21, to which the holding sheet 22 is adhered, are folded back in a direction opposite a mounting surface of the article M along lines for bend 23 marked on the board surface of the baseboard 21 of both the sides of the article M as shown in FIG. 11, and further both end parts of the board surface of the baseboard 21 are respectively erected upward and the packing structure is housed in an outer casing 26 for transportation as shown in FIG. 12.

In the packaging structure as shown in FIG. 9, both side edges of the baseboard 21 are folded back to the back side so that the flexible film employed as the holding sheet 22 is tensed, and then the article M can be stably supported in the outer casing 26 by being press-fitted to the flexible film and fixed to the board surface of the baseboard. However, as clearly shown in FIG. 12, the article M is simply mounted on an upper surface of the baseboard 21 that fold-back edges of both the side edge parts 24 are folded on a lower surface of the baseboard 21. Therefore, there remains a problem that impact force is directly applied to the article M through the baseboard 21 from the bottom of the outer casing 26 and which causes a high risk to the article M when the outer casing 26 in which the article is housed is erroneously dropped during transportation or other handling.

However, regarding the above problem, a proposal has been disclosed in U.S. Pat. No. 5,678,695 that folding end portions 27 are provided in the baseboard 21 as shown in FIG. 13 and erected at both sides of the article mounting surface of the baseboard 21 to form a buffer space below the article mounting surface as shown in FIG. 14. However, there arise problems that not only the pasteboard itself of the baseboard 21 becomes larger but also it takes a long time for assembly work by special parts as the folding end portions 27 provided in the baseboard 21. Additionally, since the protection measure for the article M from an impact such as a drop wholly depends on only the tightening force of the press of the holding sheet 22, the article reaches the side edge or end edge of the baseboard 21 while slipping on the board surface of the baseboard 21 against the tightening force of the holding sheet 22 when an article such as a notebook computer, which is relatively thin and heavy, is housed in the packaging structure. Thus, there remains a risk that the impact applied to the outer casing is directly applied to the article M which accommodated in a outer casing.

SUMMARY OF THE INVENTION

A problem to be solved is as follows; in a packaging structure constituted by a combination of a baseboard and a flexible film, a part of the baseboard is bent so that the flexible film employed as a holding sheet is tensed, but which simply means the bent part is stacked on a bottom surface of the baseboard. Further, when the packaging structure housing an article is packed in a casing, no buffer space between the bottom of the casing and the baseboard can be obtained and a specific part is required to be applied to the baseboard so that the buffer space between the bottom of the casing and the baseboard can be obtained.

The main characteristic of the present invention is that the specific part is not required to be applied to the baseboard; and the buffer space can be naturally formed below the baseboard only by a regular bend of a part of the baseboard to which the holding sheet is attached.

The article is placed between the baseboard as a packing implement of the invention and the holding sheet, leg parts of both falling parts are squarely bent downward from end edges of the baseboard, bottom parts of the leg parts are then horizontally bent, and rising parts are folded back upward from both side edges of the baseboard, and thus pressing parts naturally come into close contact with an outer surface of the rising part, both the falling parts are held at a fixed position, and the buffer space having a height corresponding to the leg part is naturally formed between the baseboard and the bottom part. Additionally, when the packing implement is housed in an outer casing, buffer spaces are naturally formed at both sides of the housed article, that is, between the leg parts and inner walls of the outer casing. Further, for example, when a casing, of which an upper surface is opened, is formed with use of both shape retaining parts, components can be housed in the casing. Furthermore, the shape retaining part can be used as a spacer for supporting an upper packing implement for goods transportation by being made to hold structural strength or thickness when two or more tiers packing implements for goods transportation are stacked and packed into the outer casing.

DETAILED DESCRIPTION OF THE EXAMPLES

The present invention can realize an object for forming a buffer space at the side of an article mounting surface of a baseboard in addition to below thereof without great change of the structure of a shape retaining part (holding part).

A packing implement for goods transportation of the present invention packs goods to be housed in an outer casing as an inner body which serves as a buffer material.

The packing implement of the present invention is made of corrugated paper. The article which should be stored in this packing implement is, for example, a notebook computer, however, it is not limited to a flat article. Even if it is a tall article, storing is possible.

Figure 1A:
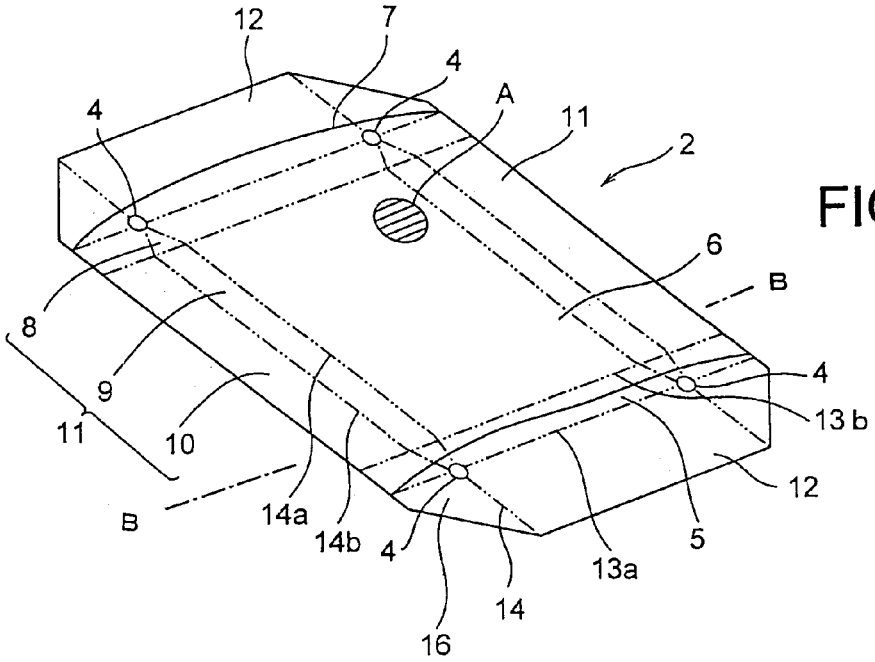
FIG. 1(*a*) is a developed view showing an embodiment of the packing implement of the present invention, and FIG. 1(*b*) is a cross sectional view taken along line B-B in FIG. 1(*a*)
Figure 1B:
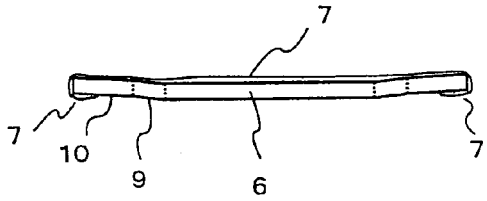
Figure 2A:
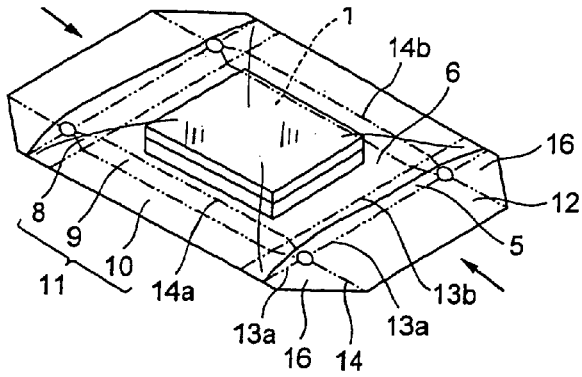
FIGS. 2(*a*), 2(*b*) and 2(*d*) are views showing steps for packing an article with use of the packing implement of the present invention in order, and FIG. 2(*c*) is a cross sectional view taken along line C-C in FIG. 2(*d*)
Figure 2B:
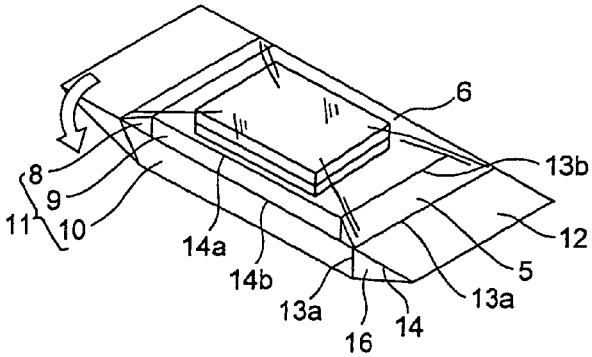
Figure 2C:
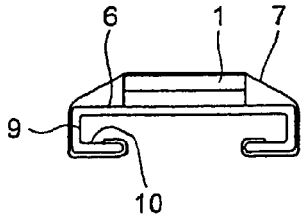
Figure 2D:
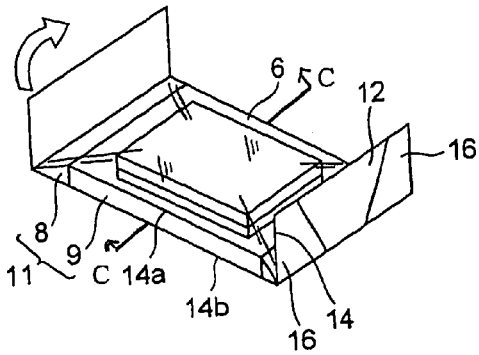
Figure 3:
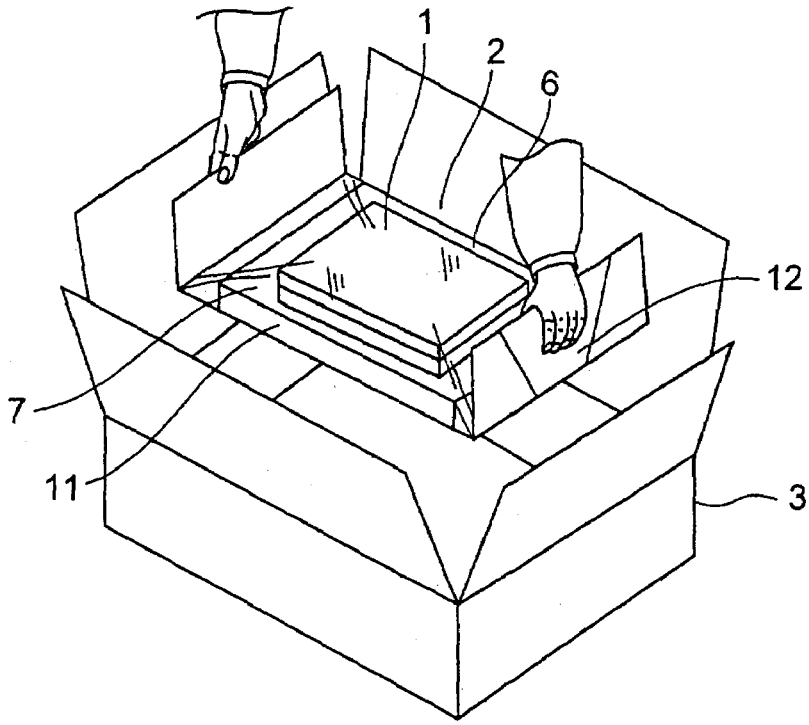
FIG. 3 is a view showing a step for housing the packing implement with the article packed in an outer casing.

A packing implement 2 has a combination of a baseboard 6 and a holding sheet 7 as shown in FIG. 1, and is housed in the outer casing with holding the article 1 as shown in FIGS. 2(*a*) to 2(*d*).

In FIGS. 1(*a*) and 1(*b*), the baseboard 6 of the packing implement 2 is a rectangular board of which an upper surface supports the article 1, has falling parts 11 and 11 at left and right side edges of the board surface of the long side of the rectangle, and has rising parts 12 and 12 at front and rear end edges of the board surface of the short side thereof.

The falling parts 11 and rising parts 12 are front parts of the side edge and end edge of the rectangular baseboard 6 respectively.

The falling part 11 includes a leg part 9 and a bottom part 10 of the front part thereof. The leg part 9 is a part to be made orthogonal to the board surface of the baseboard 6, and the bottom part 10 is a part to be bent parallel with the baseboard 6. A center part of the leg part 9 is wide, both ends thereof are triangular, and a tip of an acute angle of each triangle parts 8 is continued to the rising parts 12.

In FIG. 1, the reference symbol 14*a* denotes a line along which the leg part 9 is bent downward and 14*b* denotes a line which divides the bottom part 10 from the leg part 9, and the reference symbol 14 denotes a line for a bend extended from a junction point of both the lines 14*a* and 14*b* to an end edge of the rising part 12. The triangles 8 of both the ends of the leg part 9 are respectively formed by junction of the lines 14*a* and 14*b*, and down tilting parts 5 projected to both sides are formed at base parts of the rising parts 12.

The rising parts 12 are parts to be folded back upward from the down tilting part 5 formed at the end edge of the baseboard 6. When a circular opening 4 is provided at the junction point of the lines for bend 14*a* and 14*b*, the rising part 12 can be easily bent. In FIG. 1, the reference symbol 13*a* denotes a line for a bend of the down tilting part 5 and 13*b* denotes a line for a bend of the rising part 12. When the falling part 11 is folded back downward from the baseboard 6 and the rising part 12 is folded back upward from the baseboard 6, the triangle 8 of the end of the leg part 9 becomes a part projected to the side as shown in FIG. 2(*b*).

A shape retaining part 16 is a corner part of the baseboard 6 where the falling part 11 divided with the line for bend 14 and the line for bend 13*a* overlaps with the rising part 12. In this example, an outer end of the shape retaining part 16 is obliquely cut off, however, the shape thereof may be rectangular, any shape is applicable. The shape retaining part 16 becomes a part for being brought into contact with an outer surface of the rising part 12 and for supporting the falling part 11 in a fixed form.

The holding sheet 7 is a sheet that ends thereof are respectively folded back to a back surface side of the baseboard 6 and fixed to the left and right side edges of the baseboard 6 (end edges of a back surface of the falling part). It is important for the present invention to provide the falling parts 11 at the long sides of the rectangular baseboard 6. Due to the falling parts 11 provided at the long sides of the rectangular baseboard 6, the length of the holding sheet 7 is sufficient if there is an even length necessary for covering the board surface of the narrow rectangular baseboard 6.

To the contrary, when the falling parts 11 are provided at the short sides of the rectangular baseboard 6, not only is the length of the holding sheet 7 necessary for covering the surface of the rectangular baseboard 6 simply increased but also the stretch rate of the holding sheet 7 becomes larger. Therefore, the force for pressing the article is weakened. In the present invention, since the falling parts 11 are provided at the long sides of the rectangular baseboard 6 respectively and the holding sheet 7 is attached so as to bridge over both the falling parts 11 and 11, the holding sheet 7 may be short, the stretch rate of the sheet is small and a strong pressing force can be obtained.

A stretchable sheet is employed as the holding sheet 7 so that an impact or pressure such as flexibility or plasticity can be absorbed or avoided. It is desirable that a transparent film made of thermal plastic resin is employed as the holding sheet 7 in terms of consideration for environment, recycling, sanitation, design characteristics or the like.

Further, when an article to be housed is thin and heavy, there is a possibility that the article to which the impact is applied overcomes the pressing force of the holding sheet 7 to slip and collide with a board surface of the rising part 12 at the side of the sheet 7. The holding sheet 7 is required to have a film including more than a certain strength and physical property irrespective of the quality in order to avoid the above situation.

Moreover, in the present embodiment, the holding sheet 7 is adhered and fixed to a paper surface of the baseboard 6 by thermal welding fixation or an adhesive, but may be attached to the paper surface by attachment fixation, etc., such as use of double-stick tape. Additionally, the stretchable holding sheet 7 of the present embodiment may be formed of non-woven fabric, woven fabric, knit or the like.

Next, procedures for packing the article with use of the packing implement of the present invention will be explained. In FIG. 2(*a*), both the falling parts 11 and 11 firstly are folded back slightly upward, a space between the baseboard 6 and the holding sheet 7 is opened and the article 1 is placed between the baseboard 6 and the holding sheet 7 from a surface side of the rising part 12.

Next, as shown in FIG. 2(*b*), both the falling parts 11 are bent downward along the lines for bend 14*a* and 14*b* against the tension of the holding sheet 7. Thus, the leg part 9 of the falling part 11 is squarely bent to the baseboard 6 as shown in FIG. 2 (*c*), the bottom part 10 of the falling part 11 is bent parallel with the baseboard 6, and the shape retaining part 16 is stacked on the back surface of the rising part 12. The triangles 8 of both the ends of the leg part 9 are projected to both the sides outward respectively, and thus the holding sheet 7 is pulled by the falling part 11 to be tensed and squarely bent at the leg part 9.

Next, in FIG. 2(*d*), the rising part 12 is folded back upward from the end edge of the baseboard 6, the shape retaining part 16 is erected integrated with the rising part 12 brought into contact with the outer surface of the rising part 12, the erectness of the shape retaining part 16 is kept as long as the rising part 12 is held by hands, the leg part 9 of the falling part 12 is kept square to the baseboard 6, and the bottom part 10 is kept parallel with the baseboard 6. The erectness of both the rising parts 12 and 12 is held, and thus the holding sheet 7 is bent at the down tilting part 5 of the base part of the rising part 12, squarely bent at the leg part 9 of the falling part side to be tensed, press-fits the article 1, and holds the article 1 at the fixed position on the baseboard 6. The packing implement 2 packing the article 1 is placed into the outer casing 3 in its entirety, the outer casing 3 is lidded and the packing is completed.

In the present invention, the article 1 is housed in the outer casing 3 being supported by the packing implement 2. However, the rising part 12 and the falling part 11 of the packing implement 2 constituted by the bend of the end edge parts of the baseboard 6 possess recovery force, more particularly, a strong recovery force based on the tension of the holding sheet 7 is applied to the falling part 11, the falling part 11 is pressed to a lower bottom of the outer casing 3, and the rising part 12 is brought into press-contact with an upper bottom surface of the outer casing 3 by the recovery force of the holding sheet 7 applied to the falling part 11.

Thus, the article 1 on the baseboard 6 is stably supported at the fixed position on the baseboard 6 by the pressing force of the holding sheet 7 being housed in the outer casing 3. Further, in the present invention, the buffer space corresponding to a rising height of the leg part 9 of the falling part 11 is formed below the baseboard 6, and the triangles 8 of both the ends of both the leg parts 9 are projected to the sides of the baseboard 6 respectively so that the buffer spaces are naturally formed at both sides of the article mounting surface of the baseboard 6, on which the article is mounted,. Thus, these buffer spaces can absorb the impact applied to the outer casing 3 to effectively protect the article 1 from damage. Furthermore, when the holding sheet 7 ensures more than a certain strength, the article is stably held at the fixed position on the baseboard 6 without slipping and an influence of an impact from the outside can be eliminated even if the housing article is thin and heavy and receives the impact from the outer casing.

Moreover, in FIG. 1, a direction of a line inside of a circle indicated by the reference symbol A shows a direction of a flute of the corrugated paper. The corrugated paper is bent with a relatively small force in the direction along the flute, but needs a relatively large force in order to be bent in a direction orthogonal to the flute.

(Embodiment) Embodiments of the present invention will be described below. In the experiment, the strength of a holding sheet 7 necessary for preventing a notebook computer (size: 308 mm×265 mm×43 mm, weight: 3.2 kg) from slipping and holding it at the fixed position was measured with the notebook computer as an article to be housed packed in a packing implement for goods transportation of the present invention. In the experiment, films as follows were used as a holding sheet of the embodiment 1 specially selected in the present invention.

(Embodiment 1) The film was formed in such a way that a resin, in which 75 parts of polyethylene of single site catalyst polymerization (PL-1880, made by Dow Chemical Company Japan, density: 0.920); 25 parts of EVA (NVC-3770, made by Nippon Unicar Company Limited, density 0.940); and 3 parts of anti-blocking agent (Nippon Unicar, AB 40%) are blended, and pressed out into a single layer, and the film had tension as follows:

film width 47 cm; thickness 100 μm; and the tension at the stretch rate of 10% (10% Mod) was 0.52 kg/cm (5.1 MPa)

(Comparison 1) The film was urethane film (Pellethane 2103, made by Dow Chemical, Ether series, hardness: 90 A) and had tension as follows:

film width 47 cm; thickness 100 μm; and the tension at the stretch rate of 10% (10% Mod) was 0.33 kg/cm (3.25 MPa).

Figure 4A:
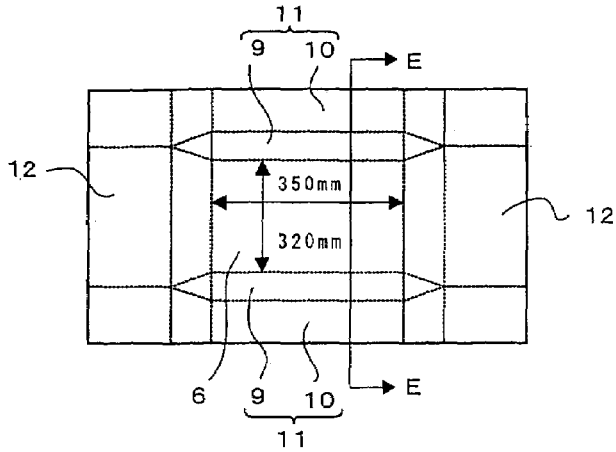
FIG. 4(*a*) is a developed view showing the packing implement used for the embodiment of the present invention, FIG. 4(*b*) is a cross sectional view taken along line E-E in FIG. 4(*a*), and FIG. 4(*c*) is a view showing a state where the article is packed in the packing implement.
Figure 4B:
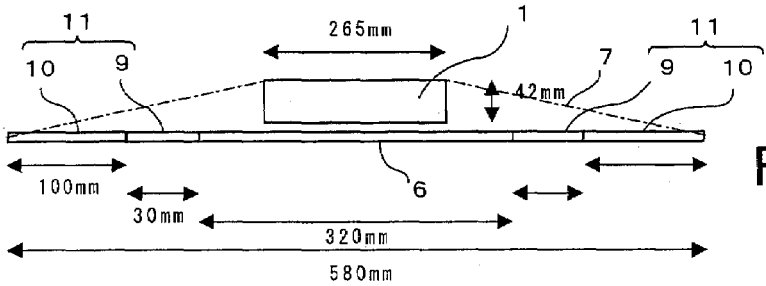
Figure 4C:
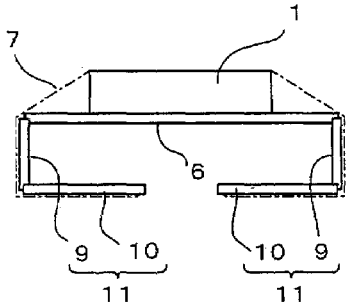

As a baseboard, a corrugated paper was employed the size of an article mounting surface 350 mm×320 nm, the width of a leg part 9 30 mm and the width of a bottom part 100 mm, as shown in FIG. 4(*a*). Each film of the embodiment 1 and the comparison 1 was stretched over both bottom parts 10 and 10 of falling parts at the long sides of the baseboard of which the whole length is 580 mm. In FIG. 4(*b*), when the notebook computer was placed between the baseboard 6 and the holding sheet 7, the whole length of the stretched holding sheet was 592 mm. Therefore, the stretch rate of the holding sheet 7 was 2.1% (592/580=1.021).

At this time, the reaction force of the film 100 μm of the comparison 1 to the notebook computer was 4.7 kg (the tension at the stretch rate of 2.1%:0.10 kg/cm (0.97 MPa), the width of the film covering the notebook computer: 47 cm, 0.10 kg/cm×47 cm=4.7 kg). Additionally, the reaction force of the film 100 μm of the embodiment 1 to the notebook computer was 7.52 kg (the tension at the stretch rate of 2.1%: 0.16 kg/cm, the width of the film covering the notebook computer: 47 cm, 0.16 kg/cm×47 cm=7.52 kg). The leg parts 9 and the bottom parts 10 were folded back as shown in FIG. 4(*c*) to pack the notebook and one of the rising parts 11 was tilted downward. However, since the reaction force exceeded the weight of the notebook computer, the notebook was fixed to the fixed position.

Additionally, the film was stretched to press the notebook computer, and the limitation of the tension necessary for easily bending the leg part 9 and the bottom part 10 was examined. The tension at the stretch rate of 2.1% was 0.16 kg/cm (1.55 MPa) as shown in the embodiment land the comparison 1. As reference examples, examinations regarding high density polyethylene film (HDPE), low density polyethylene film (LDPE), linear low density polyethylene film (L-LDPE) and ethylene vinyl alcohol (EVA) were performed under the same conditions in addition to the films used for the embodiment 1 and the comparison 1. The examination results are shown in Table 1.

TABLE 1

| Examination Item | Direction | % | Unit | HDPE | LDPE | L-LDPE | EVA | Embodiment 1 | Comparison 1 |
|---|---|---|---|---|---|---|---|---|---|
| Thickness | | | μm | 30 | 70 | 65 | 100 | 100 | 100 |
| Fracture | MD | | Mpa | 48.8 | 24.1 | 29.0 | 17.2 | 32.5 | 71.2 |
| Strength | TD | | | 34.3 | 14.4 | 24.6 | 14.8 | 33.1 | 69.4 |
| Elongation | MD | | % | 364.0 | 230.0 | 587.0 | 320.0 | 669.0 | 571.0 |
| | TD | | | 525.0 | 450.0 | 724.0 | 537.0 | 684.0 | 600.0 |
| Mod | MD | 5% | Mpa | 15.2 | 8.2 | 8.4 | 3.4 | 3.7 | 1.8 |
| | | 10% | | 18.5 | 11.0 | 10.7 | 5.2 | 5.1 | 3.3 |
| | | 50% | | 20.1 | 10.0 | 12.4 | 8.1 | 7.3 | 6.5 |
| | | 100% | | 20.5 | 9.7 | 12.3 | 9.8 | 8.3 | 7.6 |
| | TD | 5% | | 21.2 | 7.7 | 9.6 | 2.9 | 3.2 | 1.6 |
| | | 10% | | 21.5 | 9.1 | 12.2 | 4.8 | 4.7 | 3.1 |
| | | 50% | | 17.2 | 13.4 | 10.5 | 6.4 | 6.7 | 6.3 |
| | | 100% | | 17.6 | 17.4 | 10.6 | 6.9 | 7.5 | 7.3 |
| Easiness to hold a notebook computer from the top of a film | | | | C | C | C | B | B | A |

Wherein [C] is "too hard," [B] is "suitable," [A] is "too soft"

The examination results revealed that a condition where the 5% Mod equal to or less than than 3.7 MPa is necessary for stretching the film to press the notebook computer and for easily bending the baseboard. Although both the embodiment 1 and the comparison 1 satisfied the limitation value, the 5% Mod of the film of the comparison 1 was 1.8 MPa and the film was too soft. Additionally, among the reference examples, although EVA satisfied the condition where the 5% Mod was not more than 3.7 MPa it was apparent that all films of the rest of the reference examples were too hard.

Figure 5:
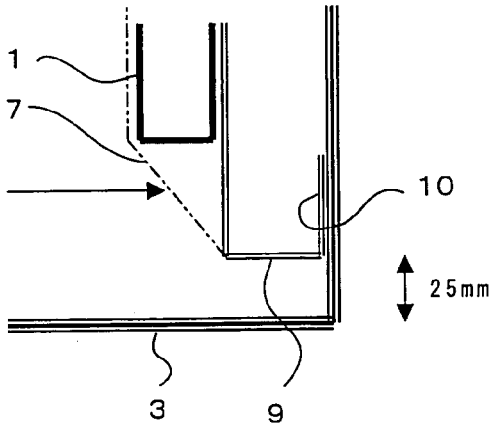
FIG. 5(*a*) is a view showing a state where the packing implement of the embodiment of the present invention is housed in the outer casing, and FIG. 5(*b*) is a view showing a state where tightening force of a holding sheet is small.
Figure 5:
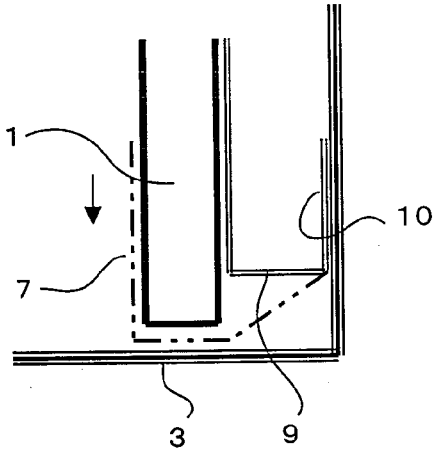

Next, an impact examination was performed that an outer casing in which the notebook computer was packed was dropped on a floor from the height of 70 cm. In the usual case, the packing implement, in which an article is packed, is housed in the outer casing 3 in such a way that both rising parts 12 and 12 are brought into close contact with an inner wall of the outer casing 3 and both the leg parts 9 and 9 are respectively placed at the fixed interval (for example, 25 mm) to the inner wall of the outer casing 3 as shown in FIG. 5(*a*) When the outer casing 3 is dropped on the floor, if the tightening force of the holding sheet 7 is small, as shown in FIG. 5(*b*), the holding sheet 7 is stretched near the inner wall of the outer casing 3 and is collided with the inner wall of the outer casing 3 if further stretched at the time when the outer casing reaches the floor.

However, when the holding sheet 7 can withstand an entire load of the notebook computer, the collision can be avoided. When the outer casing 3 is quadrilateral casing, the distance between the packing implement 2 and the outer casing 3 is about 25 mm. Therefore, if the article 1 collides with the outer casing 3, the holding sheet 7 is stretched by about 50 mm (25 mm×2). As shown in FIG. 4(*c*), the initial holding sheet 7 was stretched at 2.1% and the whole length thereof became 592 mm. When the above stretch distance of 50 mm is further added to the whole length by the collision, the final whole length of the holding sheet 7 becomes 642 mm.

As a result, the holding sheet is stretched at about 10% (642/580=1.106). The potential energy F (=mgh) of the notebook computer was 21.95 kgf (=3.2×9.8 (G)×0.7). Since the tension of the urethane film of the comparison 1 was 0.33 kg/cm (3.25 MPa) and the film width was 47 cm, the tensile force of the urethane film at the stretch rate of 10% was 15.51 kg (=0.33×47). On the other hand, since the tension of the film of the embodiment 1 was 0.52 kg/cm (5.1 MPa) and the film width was 47 cm, the tensile force of the film at the stretch rate of 10% was 24.44 kg (=0.52×47).

The film of the embodiment 1 thus had a tensile force about twice as that of the film of the comparison 1, and the difference was significant. Although the holding sheet 7 made of the film used for the embodiment 1 could withstand the drop energy of the article 1, the holding sheet 7 made of the film used for the comparison 1 could not withstand the drop energy of the article 1.

The outer casing, in which the packing implement packed with the article with use of the film of the embodiment 1 or the comparison 1 was housed, was dropped from the height of 70 cm. Moreover, this drop test was performed according to ISO 2248, that is, one corner, three ridges and six faces of the outer casing were respectively collided with the floor so that the impact acceleration G of each colliding part could be measured. In the measurement, the impact acceleration tester made by Kyowa Dengyo was used. The table 2 represents the measurement result of each impact acceleration G.

TABLE 2

| | Data; G value | | | | | | | | | |
|---|---|---|---|---|---|---|---|---|---|---|
| Film Grade | 2-3-5 corner | 2-3 ridge | 3-5 ridge | 2-5 vertical ridge | 1 top surface | 2 side surface | 3 bottom surface | 4 side surface | 5 edge | 6 edge |
| Embodiment 1 | 23.4 | 32.0 | 27.2 | 58.1 | 38.0 | 80.0 | 48.0 | 90.0 | 52.0 | 40.0 |
| Comparison 1 | 24.0 | 30.0 | 28.0 | 48.0 | 40.0 | 26.0 | 36.0 | 28.0 | 50.0 | 42.0 |

The table 2 clearly reveals that the difference of the buffer effect between the film used for the embodiment 1 and the film used for the comparison 1 is particularly remarkable in the side surface.

The holding sheet 7 used for the packing implement, in which an article of a thin object such as a notebook computer, mounting substrate or panel is packed, is required to be selected in consideration of the positional energy calculated based on an assumed drop height, the width and the tensile force when being stretched at 10%. Thus, the article can be held at the fixed position. The above experiment results revealed that when a film the same as the film used for the embodiment 1, a resin film, is selected, the resin film having a physical property which satisfies a condition of the 5% Mod is equal to or more than 3.7 MPa and 10% Mod is in a fixed range of 4.0 to 8.0 MPa, centering on 5.1 Mpa, and is attached to both the falling parts while bridging over the surface of the narrow side of the rectangular baseboard, even a thin and heavy object such as a notebook computer can be fixed to the fixed position with no slip.

Therefore, it is apparent that the article of the thin object such as a notebook computer can be stably packed with use of the holding sheet made of the film satisfying at least the above condition. Additionally, regarding the fracture elongation and fracture strength required for the holding sheet, it is desirable that the holding sheet has a physical property that the fracture elongation is 300 to 700% and the fracture strength is 15 to 80 MPa.

When the urethane film is used for the holding sheet, it is desirable that the hardness is equal to or more than 90 A. When a film, in which ethylene-vinyl acetate and polyethylene resin, or metallocene catalyst or single site catalyst polymerization polyolefin resin are blended (10 to 40:90 to 60), is used for the holding sheet, it is desirable that the thickness is 50 to 150 μm, more desirable is 75 to 100 μm in terms of economy. Moreover, the kind of a film used for the holding sheet is not limited, and as long as the film has elasticity, anything is applicable. For example, natural rubber, various synthetic rubbers, polystyrene elastomer such as SEBS or SIPS, polyester thermoplastic elastomer, polyurethane thermoplastic elastomer, polyethylene elastomer, polyamide elastomer, ethylene-vinyl acetate copolymer, single site catalyst or metallocene catalyst polymerization polyolefin or the like is applicable.

In particular, selective employment of resin in which ethylene-vinyl acetate copolymer and polyolefin (HDPE, MDPE) blended or resin in which single site catalyst or metallocene catalyst polymerization polyolefin blended therewith in accordance with a purpose or use is effective for packing of the thin object such as a notebook computer, mounting substrate or panel.

Figure 6A:
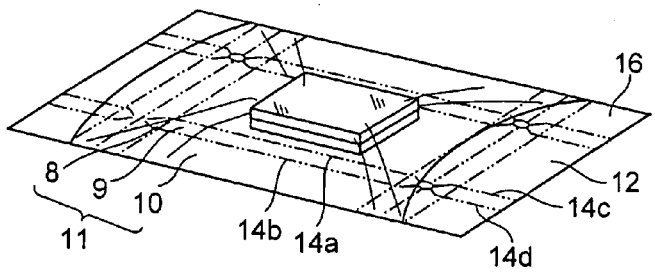
FIGS. 6(*a*) to 6(*c*) are views showing steps for packing the article with use of a packing implement of a second embodiment in order.
Figure 6B:
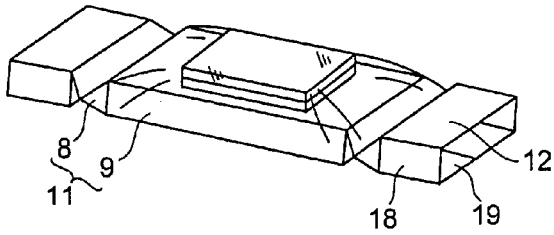
Figure 6C:
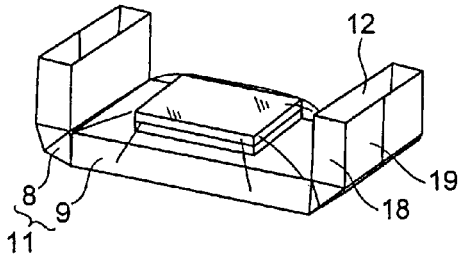

(Embodiment 2) FIG. 6 shows an attempt to further functionally use the shape retaining parts. In FIG. 6, the shape retaining parts formed at both the ends of the rising part 12 are used for casing bodies of which upper surfaces are opened. In FIG. 6(*a*), lines for bend 14*c* and 14*d* are attached to the rising part 12 and the shape retaining part 16, the lines 14*c* and 14*d* extending from a junction point of a line for bent 14*a*, along which the leg part 9 is bent downward, and a line for bent 14*b*, which divides the bottom part 10 from the leg part 9, to end edges of the rising part 12 and the shape retaining part 16 is symmetrical to the lines for bent 14*a* and 14*b*. As shown in FIG. 6(*b*), the leg part 9 and the bottom part 10 are respectively formed by bending along the lines for bend 14*a* and 14*b*, meanwhile the rising part 12 and the shape retaining part 16 are respectively bent along the lines for bend 14*c* and 14*d* and form a side wall 18 and an end surface 19 of the casing body. Then, as shown in FIG. 6(*c*), when the rising parts 12 are erected, the casing bodies, of which each upper surface is opened, are formed at both ends of the packing implement. For example, a wiring cord or other components of the notebook computer can be housed in the casing body. The casing body formed by the rising part 12 as the shape retaining part 16 is not limited to housing components, and also can be used as a spacer to separate an upper packing implement from a lower packing implement when the packing implements are stacked up more than two tiers and housed in the outer casing 3.

Figure 7A:
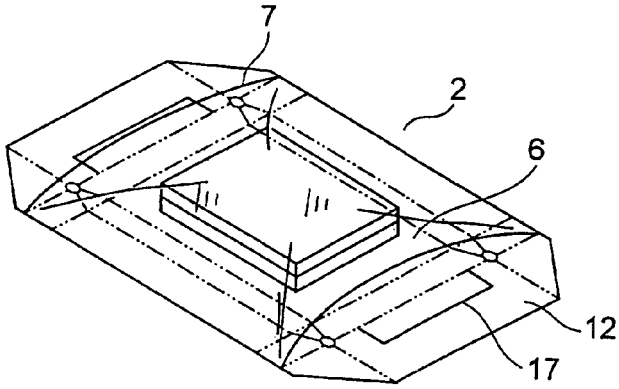
FIGS. 7(*a*) to 7(*c*) are views showing an example that slits are opened in rising parts.
Figure 7B:
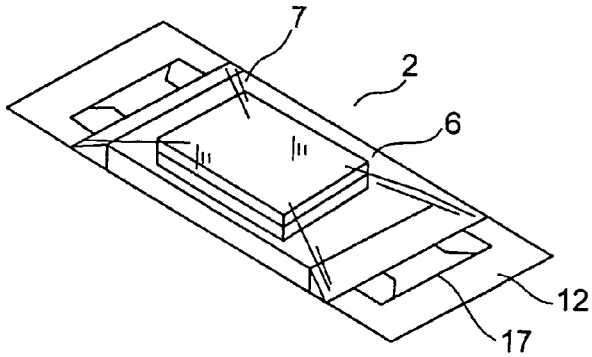
Figure 7C:
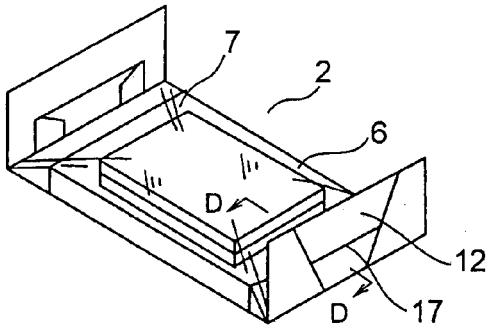
Figure 8:
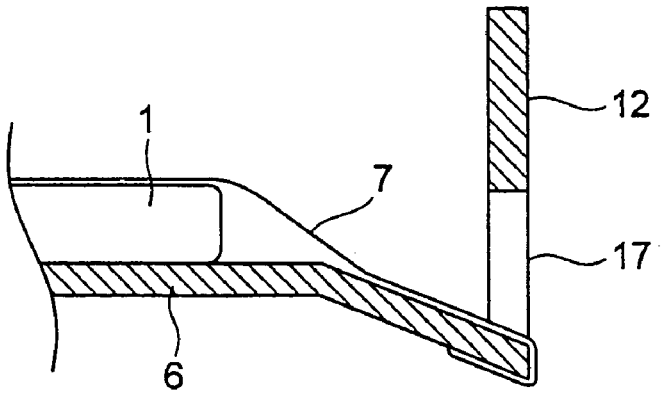
FIG. 8 is a cross sectional view taken along line D-D in FIG. 7.
Figure 9:
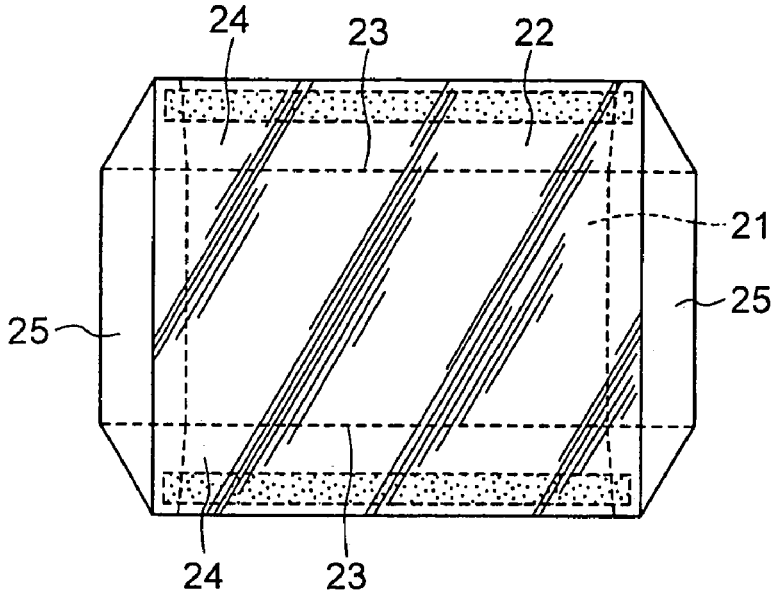
PRIOR ART FIG. 9
FIG. 9 is a developed view showing an example of conventional packing structures for goods transportation.
Figure 10:
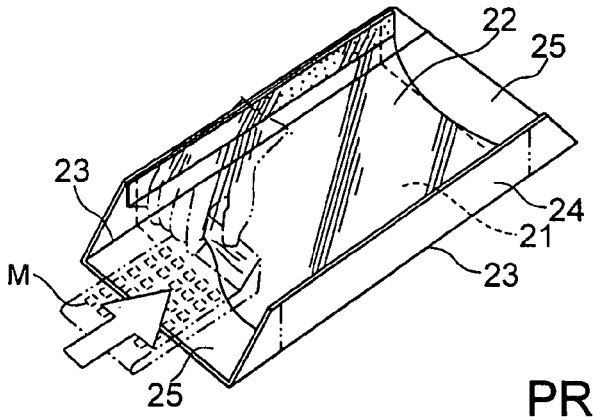
PRIOR ART FIG. 10
FIG. 10 is a view showing a step for housing the article in the packing structure shown in FIG. 9.
Figure 11:
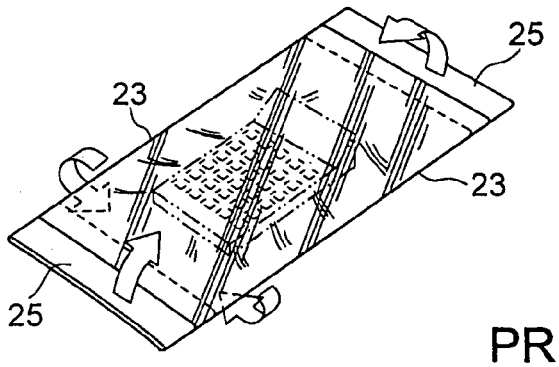
PRIOR ART FIG. 11
FIG. 11 is a view showing a step for bending a part of a baseboard and tensing a holding sheet.
Figure 12:
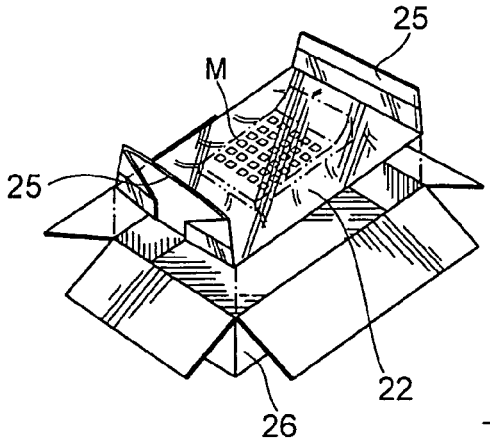
PRIOR ART FIG. 12
FIG. 12 is a view showing a step for housing the packing structure holding the article in a transportation casing.
Figure 13:
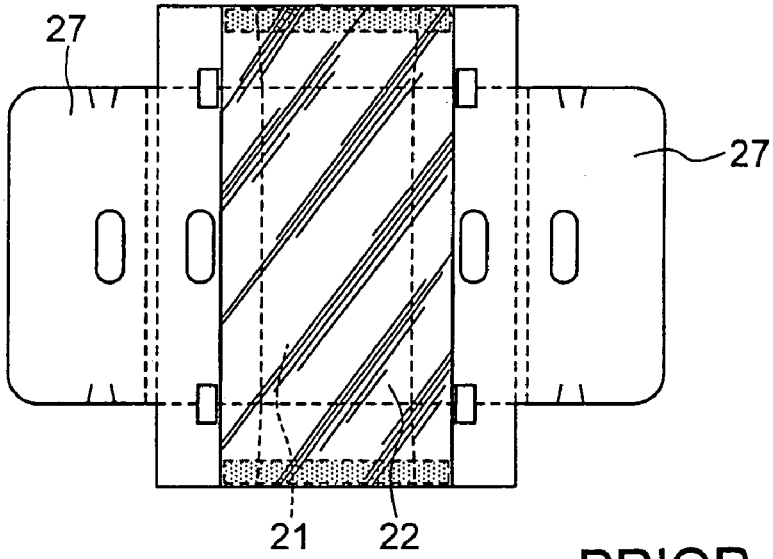
PRIOR ART FIG. 13
FIG. 13 is a developed view showing another example of the conventional packing structures for goods transportation.
Figure 14:
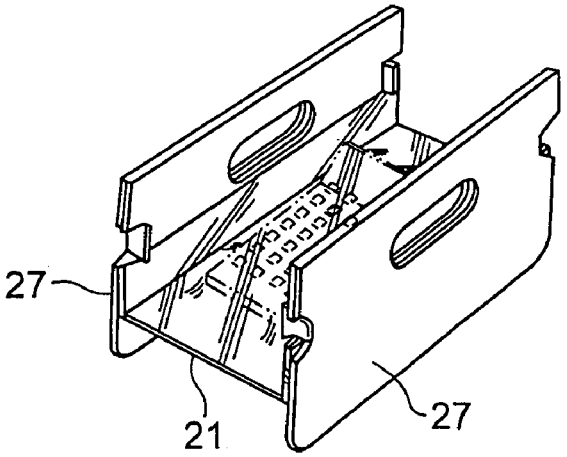
PRIOR ART FIG. 14
FIG. 14 is a view showing an assembly state when the packing structure shown in FIG. 13 holding the article is housed in the transportation casing.

In the present invention, when an oblong slit 17 is opened in the rising part as shown in FIGS. 7(*a*) to 7(*c*), the opening can be used as a handle for holding of the packing implement 2. Additionally, as shown in FIG. 8, when an end of the holding sheet 7 is folded back on an outer surface of one of the rising parts 12 and 12 through the slit 17 and the fold-back end is fixed to the rising part 12, each three sides of the holding sheet 7 and the baseboard 6 are closed, and therefore the article can be reliably prevented from dropping out. Further, when the end of the holding sheet 7 is fixed to the outer surface of the rising part 12 through the slit 17 and another end thereof is attachably or detachably fixed to another rising part 12, four sides of the holding sheet 7 can be fixed after the article is packed.

As a matter of course, the present invention is applicable to not only a packing implement for transportation of notebook computers but a packing implement for transportation of electronics devices the same as the notebook computer or fragile articles such as tableware. Additionally, a state of the packed article can be made see through from the outside with use of a transparent holding sheet. The packing implement for transportation of the present invention is extremely effective for transportation of goods, more particularly, as a packing implement for home delivery service.

What is claimed is:

1. A packing implement for packing an article for goods transportation, comprising:

a baseboard for supporting the article, said baseboard including a main part having parallel first sides and parallel second sides, falling parts provided outside the main part at the first sides, rising parts provided outside the main part at the second sides, and shape retaining parts provided on corners of the baseboard each connecting the falling part and the rising part adjacent thereto, and a holding sheet provided on the baseboard for covering the article and having at least two sides fixed to end edges of the falling parts, wherein the falling parts are configured to be folded downward from the first side of the main part, each of the falling parts having a leg part orthogonal to the main part and a bottom part parallel with the main part for forming a buffer space corresponding to a height of the leg part relative to the main part when folded, the rising parts are configured to be folded upward from the second sides of the main part, the baseboard has openings at intersections of the first and second sides of the main part so as to fold upward the rising part easily, each of the shape retaining parts is configured to be folded back so as to be parallel with the rising part when the falling part is folded back toward a lower surface of the main part, and integrally erected with the rising parts while contacting with a lower surfaces of the rising parts when the rising part is folded upward, when the rising part is held upward, an erection state of the shape retaining part is kept, the leg part of the falling part is kept orthogonal to the main part, and the bottom part is kept parallel with the main part, and the holding sheet is tensed by folding downward the falling part thereby pressing the article to the main part and holding the article at the fixed position.

2. A packing implement for goods transportation according to claim 1, wherein the holding sheet is a film having a physical property such that 5% Mod is equal to or less than 3.7 MPa and 10% Mod is 4.0 to 8.0 MPa.

3. A packing implement for goods transportation according to claim 1, wherein the holding sheet is a film in which ethylene-vinyl acetate and polyethylene resin, or metallocene catalyst or single site catalyst polymerization polyolefin resin are blended in a proportion of 10 to 40:90 to 60, and a thickness of the holding sheet is 50 to 150 μm, preferably 75 to 100 μm.

4. A packing implement for goods transportation according to claim 2, wherein the holding sheet is a film formed of a material selected from natural rubber, various synthetic rubbers, polystyrene elastomer including SEBS and SIPS, polyester thermoplastic elastomer, polyurethane thermoplastic elastomer, polyethylene elastomer, polyamide elastomer, ethylene-vinyl acetate copolymer, single site catalyst and metallocene catalyst polymerization polyolefin.

5. A packing implement for goods transportation according to claim 2, wherein the holding sheet is a film having a physical property such that a fracture elongation is 300 to 700% and a fracture strength is 15 to 80 MPa.

6. A packing implement for packing an article for goods transportation, comprising:

a baseboard for supporting the article, said baseboard including a main part having parallel first sides and parallel second sides, falling parts provided outside the main part at the first sides, rising parts provided outside the main part at the second sides, and shape retaining parts provided on corners of the baseboard each connecting the falling part and the rising part adjacent thereto, and a holding sheet provided on the baseboard for covering the article and having at least two sides fixed to end edges of the falling parts, wherein the falling parts are configured to be folded downward from the first side of the main part, each of the falling parts having a leg part orthogonal to the main part and a bottom part parallel with the main part for forming a buffer space corresponding to a height of the leg part relative to the main part when folded, the rising parts are configured to be folded upward from the second sides of the main part, each of the shape retaining parts is configured to be folded back so as to be parallel with the rising part when the falling part is folded back toward a lower surface of the main part, and integrally erected with the rising parts while contacting with a lower surfaces of the rising parts when the rising part is folded upward, when the rising part is held upward, an erection state of the shape retaining part is kept, the leg part of the falling part is kept orthogonal to the main part, and the bottom part is kept parallel with the main part, the holding sheet is tensed by folding downward the falling part thereby pressing the article to the main part and holding the article at the fixed position, and the shape retaining parts on each of the second sides form a hollow shape body at each end of the rising parts, said hollow shape body having an opening facing upward when the rising part is folded upward.

7. A packing implement for goods transportation according to claim 6, wherein the shape retaining parts support another packing implement for goods transportation as a spacer when the another packing implement is stacked on the packing implement.

8. A combination comprising:

the packing implement according to claim 5, and an outer casing for housing the packing implement, wherein an upper end of the rising part is supported by an upper surface of the outer casing, and a lower end of the falling part is supported by a bottom surface of the outer casing so as to hold the main part with intervals to the upper and lower surfaces of the outer casing.

9. The combination according to claim 8, wherein when the packing implement is housed in the outer casing, the leg part of the falling part forms a space relative to the main part, and each end of the leg part has a triangle part projecting from each side of the main part and forming a space for absorbing an impact applied to the outer casing.

10. A packing implement for goods transportation according to claim 1, wherein the main part has a flute running in a direction parallel with the second sides thereof.

* * * * *